United States Patent [19]

Yasuoka

[11] Patent Number: 4,777,918

[45] Date of Patent: Oct. 18, 1988

[54] METHOD OF CONTROLLING IDLING ROTATIONAL SPEED IN INTERNAL COMBUSTION ENGINES

[75] Inventor: Akimasa Yasuoka, Nerima, Japan

[73] Assignee: Honda Giken Kogyo Kabushiki Kaisha, Tokyo, Japan

[21] Appl. No.: 876,916

[22] Filed: Jun. 20, 1986

[30] Foreign Application Priority Data

Jun. 24, 1985 [JP] Japan ..... 60-137449

[51] Int. Cl.[4] ..... F02D 11/10

[52] U.S. Cl. ..... 123/339; 123/340

[58] Field of Search ..... 123/339, 340, 352

[56] References Cited

U.S. PATENT DOCUMENTS 4,441,471 4/1984 Kratt ..... 123/339

4,554,899 11/1985 Engel ..... 123/339

*Primary Examiner*—Raymond A. Nelli

*Attorney, Agent, or Firm*—Lyon & Lyon

[57] ABSTRACT

When the rotational speed of an internal combustion engine is decreasing, the rate of decrease in engine rotational speed as well as the engine rotational speed are sensed. A command value dependent upon both the engine rotational speed and the speed decrease rate is generated when the engine rotational speed falls below a predetermined value, for regulating the opening of a control valve arranged in a bypass passage bypassing the engine throttle valve, to control the amount of intake air and, hence, the idling speed of the engine. Generation of the command value is terminated when the speed decrease rate falls below a predetermined threshold value preset in dependence upon engine rotational speed. Thus, the command value is outputted for a period of time which is not fixed in advance but which is controlled in dependence upon both engine rotational speed and the speed decrease rate, thereby enabling the rotational speed of the engine to be stabilized smoothly at the target idling rotational speed.

12 Claims, 4 Drawing Sheets

METHOD OF CONTROLLING IDLING ROTATIONAL SPEED IN INTERNAL COMBUSTION ENGINES

BACKGROUND OF THE INVENTION

This invention relates to a method of controlling idling rotational speed in an internal combustion engine, and more particularly to an idling rotational speed control method for coping with a sudden drop in engine rotational speed from high rpm by controlling the amount of intake air through use of a control valve provided in a bypass passage bypassing a throttle valve arranged in an intake passage of the internal combustion engine, whereby the rotational speed of the engine makes a smooth transition to a target idling speed in a feedback control mode.

When an internal combustion engine is idling or operating under a low load with the throttle valve kept in a substantially fully closed position, the conventional practice is to control the idling speed of the engine by regulating the intake air amount by means of a control valve arranged in a bypass passage bypassing the throttle valve, i.e., communicating the upstream and downstream sides of the throttle valve.

In internal combustion engines, even those equipped with an electronically controlled fuel injection system, it is commonly known that when the amount of intake air increases, there is an accompanying increase in the amount of fuel injected, which in turn results in greater supply of the mixture. According to a typical conventional method, the degree to which the control valve is opened is placed under closed-loop control when the throttle valve is substantially fully closed and, at the same time the rotational speed of the engine is in a predetermined idling speed region. More specifically, the magnitude of an excitation current supplied to a solenoid of the control valve for proportional control of the control valve opening is decided on the basis of a solenoid current command value Icmd, which is specified by the following equation:

$$Icmd = Ifb(n) \quad (1)$$

where Ifb(n) represents a PID feedback control term applied for executing proportional control (P term), integral control (I term) and differential control (D term) on the basis of a difference between target idling rotational speed Nrefo and the actual rotational speed Ne of the engine.

Assume by way of example that the engine rotational speed is raised to high rpm by opening the throttle valve to a greater degree, and thereafter the throttle valve is substantially fully closed and the engine is placed in unloaded state, as by shifting the transmission to the neutral range or stepping down on the clutch pedal. This will cause the rotational speed of the engine to undergo a sudden drop. When the engine rotational speed falls to a value within the predetermined idling speed region, the opening of the control valve is subjected to feedback control in such a manner that the engine rotational speed will approach the target idling rotational speed, as mentioned above.

However, if the downward trend exhibited by the engine rotational speed is very sudden at such time that the engine is in the unloaded state, the rotational speed will temporarily drop below the target idling speed before being stabilized at this speed by feedback control.

The applicant has already proposed, in Japanese Patent Application No. 59-267508, a method of preventing the engine rotational speed from dropping below the target idling speed so that a transition from the former to the latter can be made in smooth fashion.

According to this previously proposed method, a sharp decline in engine rotational speed from high rpm is dealt with by temporarily halting the downward trend when the rotational speed falls to rpm higher, by a predetermined value, than an upper limit value of the idling speed region. In this way the rotational speed of the engine is made to gradually approach the target idling speed. More specifically, when the engine rotational speed falls below a predetermined speed value higher than the upper limit value of the idling speed region, a current command (control variable) Isa is generated. The value of Isa is decided by the prevailing rotational speed (Ne) of the engine and the difference (ΔNe, hereafter referred to as a "speed differential") between the present value of rotational speed and the immediately preceding value thereof. The control variable Isa is outputted as the solenoid current command value Icmd for a predetermined period of time (e.g. a fixed time period) Tsa.

According to the previously proposed method described above in which the downward trend in the rotational speed of the engine is temporarily halted by outputting the control variable Isa as the solenoid current command value Icmd for the predetermined time period Tsa, the value of Tsa is preset in dependence upon the engine rotational speed Ne and the speed differential ΔNe. In other words, with the conventional method of regulating the control valve to give a wider opening in such a manner that the engine rotational speed can make a smooth transition to the target rotational speed at engine idling, control is based upon making a prediction of rotational speed. However, due to slight differences from one internal combustion engine to another, and depending upon the particular vehicle, engine rotational speed may be caused to rise somewhat by the control variable or the downward trend in the rotational speed of the engine may not be fully prevented in an appropriate manner merely by outputting the control variable Isa for the predetermined time period Tsa. With the conventional method, therefore, engine rotational speed cannot always be stabilized at the target idling speed in a smooth manner.

SUMMARY OF THE INVENTION

It is therefore an object of the invention to provide a method of controlling idling rotational speed in an internal combustion engine, whereby the rotational speed of the engine can be smoothly stabilized at a target idling rotational speed.

According to the present invention, the foregoing object is attained by providing a method of controlling idling rotational speed of an internal combustion engine having a throttle valve and a control valve arranged in a bypass passage bypassing the throttle valve, wherein the degree to which the control valve is opened is controlled in proportion to a control valve command signal to regulate the amount of air taken into the engine, thereby controlling the idling rotational speed of the engine, the method being characterized by comprising the steps of: (1) sensing the rotational speed of the engine, as well as a rate of decrease in engine rotational speed when the engine rotational speed is decreasing; (2) determining whether the sensed rotational speed falls below a predetermined value; (3) generating the control valve command signal having a command value dependent upon both the sensed engine rotational speed and the sensed rate of decrease in engine rotational speed when the sensed engine rotational speed falls below the predetermined value; (4) determining whether the sensed rate of decrease in engine rotational speed (speed differential) falls below a ptedetermined threshold value, preset in dependence upon the engine rotational speed; and (5) terminating generation of the control valve command signal when the sensed rate of decrease in engine rotational speed falls below the predetermined threshold value.

Thus, according to the invention, generation of the control variable Isa is terminated only when the speed differential ΔNe of engine rotational speed falls below the predetermined threshold value dependent upon engine rotational speed. In other words, Isa is outputted for a period of time which is not fixed in advance but which is controlled in dependence upon both engine rotational speed and the speed differential. This enables the rotational speed of the engine to be stabilized smoothly at the target idling rotational speed.

The above and other objects, features and advantages of the invention will be apparent from the following detailed description taken in conjunction with the accompanying drawings, in which like reference characters designate the same or similar elements or parts throughout the figures thereof.

DETAILED DESCRIPTION

A preferred embodiment of a method of controlling the idling rotational speed of an internal combustion engine according to the invention will now be described with reference to FIGS. 1 through 4.

Figure 1:
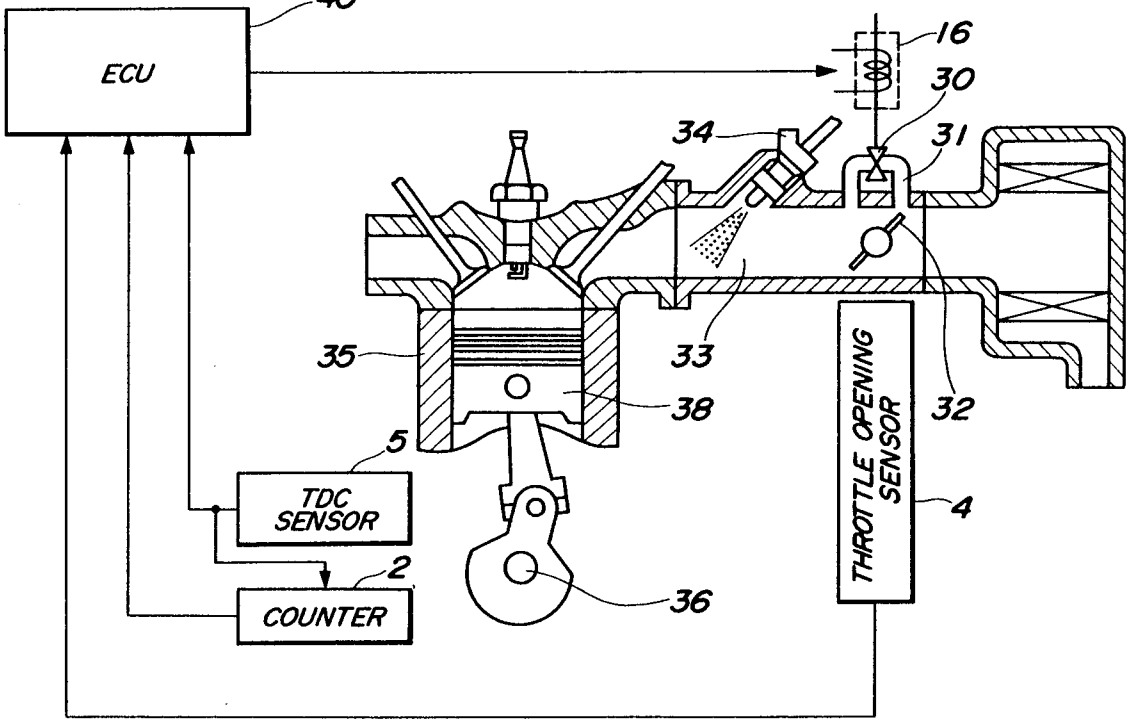
FIG. 1 is a schematic view illustrating the construction of a control system, to which the method of the invention is applied, for controlling the idling rotational speed of an internal combustion engine.

With reference first to the schematic view of FIG. 1, there is shown a control system to which the method of the invention is applied to control the idling rotational speed of an internal combustion engine. The control system includes a control valve 30 of linear solenoid type provided in a bypass passage 31 bypassing a throttle valve 32, i.e., communicating the upstream and downstream sides of the throttle valve 32, which is arranged in an intake manifold 33 of an internal combustion engine. The amount of air drawn into the intake manifold 33 when the engine is idling, which occurs when the throttle valve 32 is in a substantially fully closed position, is controlled by the control valve 30, the opening whereof is decided by the magnitude of a current that flows into a solenoid 16 of the control valve 30. Fuel injection nozzles 34, only one of which is shown, each inject fuel into the manifold 33 in an amount determined by well-known means in dependence upon the amount of intake air.

The engine has cylinders 35 which each have a piston 38 disposed to be repeatedly reciprocated in the cylinder to apply a rotating force to a crankshaft 36 connected thereto. It should be noted that the engine has a plurality of such cylinders and associated pistons, though only one is shown in FIG. 1.

The control system further includes a TDC sensor 5 for generating a pulse when the piston in each cylinder of the engine reaches a point 90° before top dead center (TDC). In other words, whenever the crankshaft 36 makes two full revolutions, the TDC sensor 5 generates pulses of a number equal to the number of cylinders. These pulses, hereafter referred to as "TDC pulses", are fed into an electronic control unit 40 (hereafter referred to as "the ECU"), which is an essential component of the control system.

Also provided in the control system is a counter 2 for sensing the rotational speed of the engine by counting the time interval between adjacent TDC pulses produced by the TDC sensor, and for converting the sensed rotational speed into a corresponding digital signal. The signal is applied to the ECU 40.

The control system also has a throttle opening sensor 4 for sensing the degree to which the throttle valve 32 is open, and for supplying the ECU 40 with a digital signal the value whereof corresponds to the throttle opening.

Figure 2:
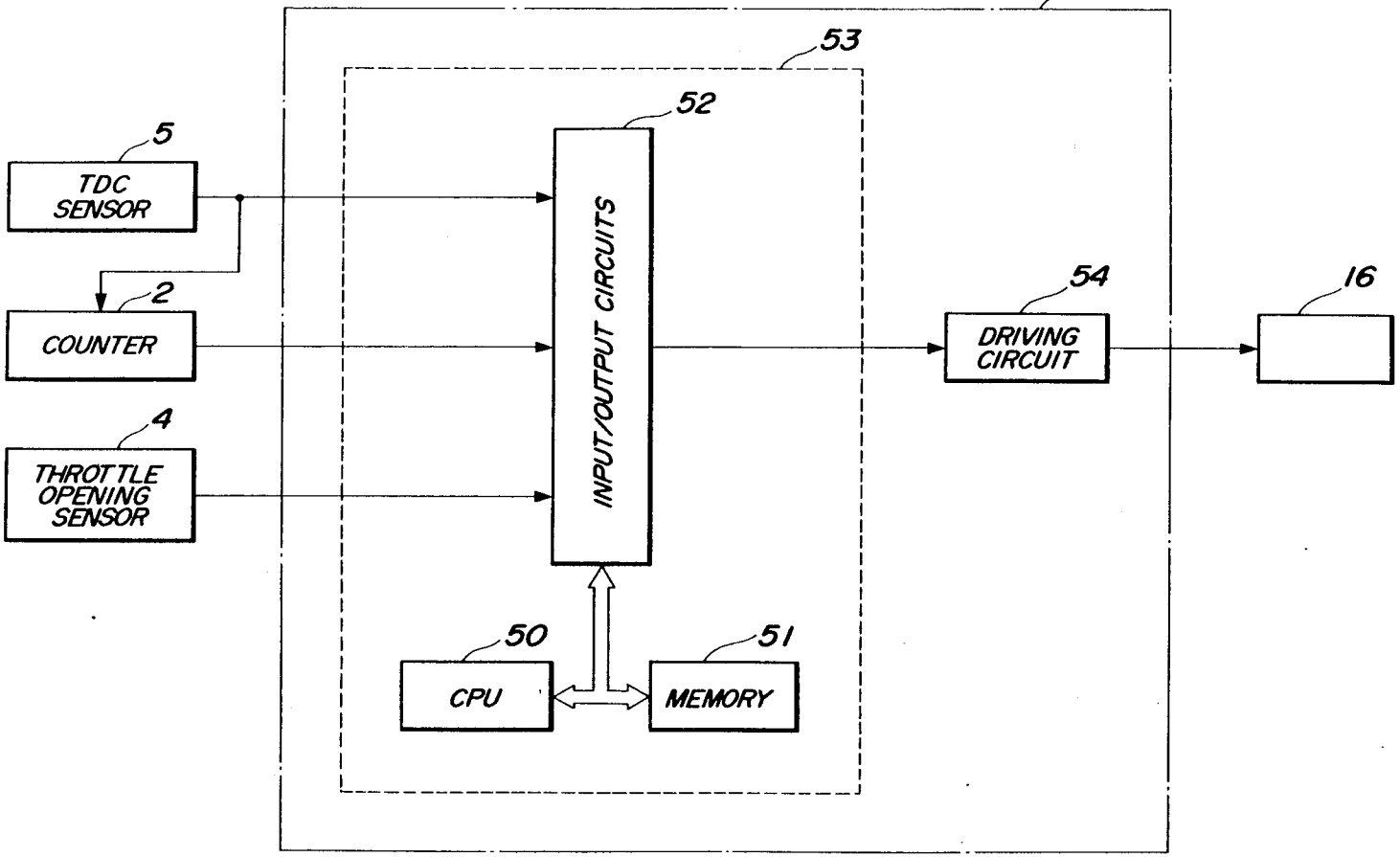
FIG. 2 is a block diagram illustrating a specific example of the internal construction of an electronic control unit included in the system shown in FIG. 1.

The ECU 40 shown in FIG. 1 has an internal construction illustrated in the block diagram of FIG. 2. Parts the same as or equivalent to those shown in FIG. 1 are designated by like reference numerals.

As shown in FIG. 2, the ECU 40 is composed of a microcomputer 53 comprising a central processing unit (hereafter referred to as "the CPU") 50, memory 51 and input/output circuits 52 serving as interfaces, and a control valve driving circuit 54 which is responsive to a command signal having a command value (the aforementioned solenoid current command value Icmd) issued by the microcomputer 53, for supplying driving current that flows into the solenoid 16. That is, the control valve driving circuit 54 provides the solenoid 16 with a driving current corresponding to the command value Icmd. The solenoid 16 responds to the driving current by causing the control valve 30 (FIG. 1) to open to the degree in accordance with Icmd, as a result of which the idling rotational speed also is controlled in dependence upon Icmd.

The control method of the invention will now be described with reference particularly to the flowchart of FIG. 3.

Figure 3:
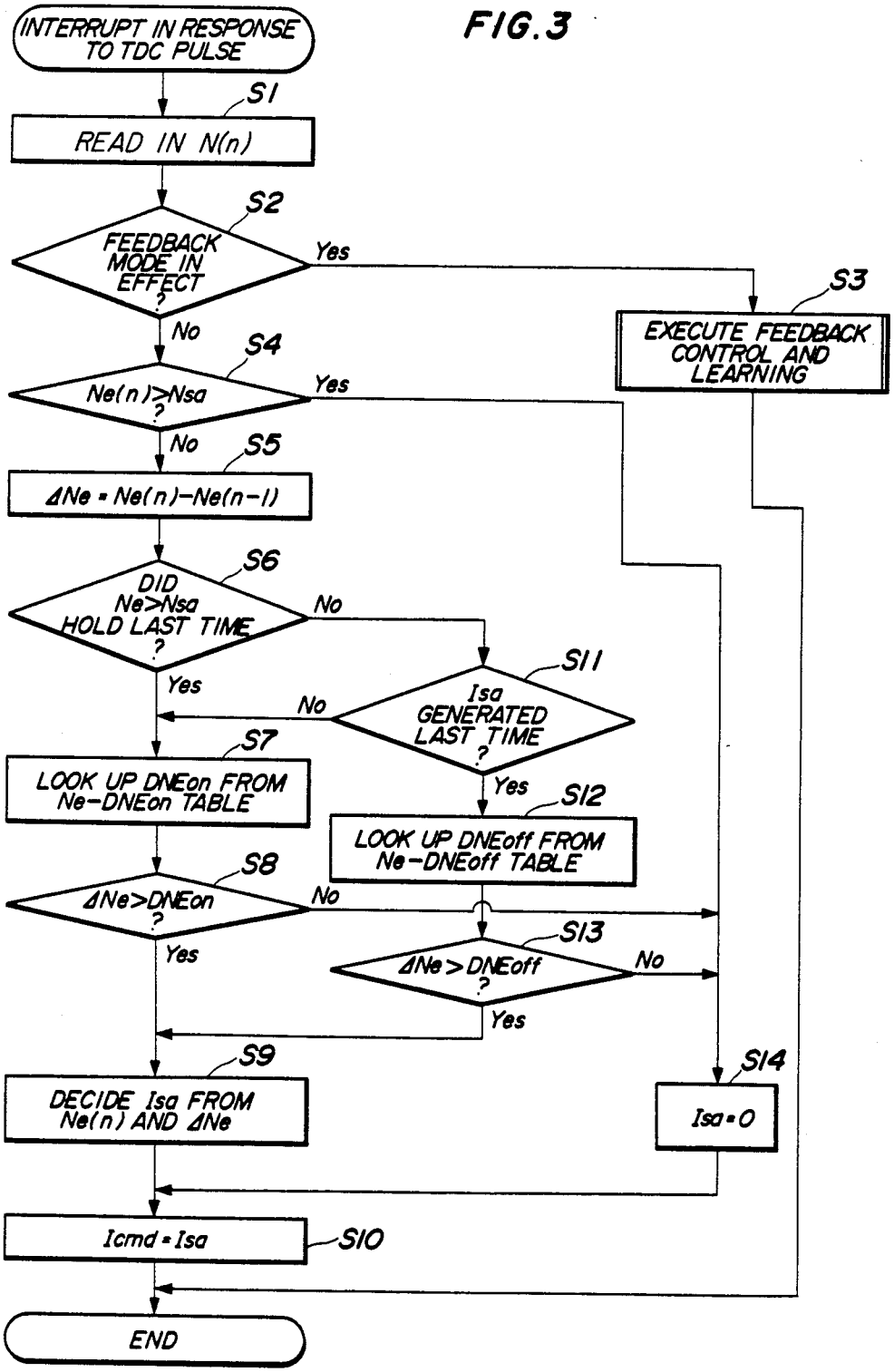
FIG. 3 is a flowchart of processing according to an idling rotational speed control method embodying the present invention.

As shown in FIG. 3, operation starts in response to an interrupt caused by each TDC pulse. The first step of the flowchart is a step S1, at which the CPU 50 reads in the engine rotational speed Ne, the present value of which is n, sensed by the counter 2. This is followed by a steo S2, at which the CPU 50 determines whether the excitation current of solenoid 16 is being controlled in a feedback control mode, here referred to simply as the "feedback mode". More specifically, the feedback mode is judged to be in effect if the throttle opening signal supplied by the throttle opening sensor 4 indicates that the throttle valve 32 is in the substantially fully closed position and at the same time the engine rotational speed signal supplied by the engine rotational speed counter 2 indicates that the rotational speed of the engine lies within a predetermined rotational speed range (an idling speed region) set with a target idling speed as a reference. The feedback mode is decided not to be in effect when the throttle valve 32 is in the substantially fully closed position but the engine rotational speed is not in the idling speed region.

If the decision rendered at the step S2 is YES, namely that the feedback mode is operative, the program proceeds to a step S3. If the answer to the step S2 is NO, the program proceeds to a step S4.

As will be described later with reference to FIG. 4, the step S3 calls for the CPU 50 to calculate a feedback control term Ifb(n), deliver the calculated Ifb(n) value to the control valve driving circuit 54 as the solenoid current command value Icmd, and store a learned value Ixref of Ifb(n) in the memory 51. The main program is restored when the processing of step S3 is completed.

The step S4 calls for a determination as to whether the engine rotational speed Ne(n) read in at the step S1 is higher than a predetermined rotational speed Nsa, which is a predetermined value above the upper limit value of the idling speed region. Note that Nsa is set at 1350 rpm in the present embodiment. If the answer to the step S4 is YES, the next step executed is a step S14; if NO, the program proceeds to a step S5.

The step S5 calls for the CPU 50 to calculate the speed differential ΔNe from the currently prevailing engine speed value Ne(n) read in at the step S1 at the present TDC pulse or in the present loop and the preceding engine rotational speed Ne(n−1) read in at the immediately preceding TDC pulse or in the last loop. The program then proceeds to a step S6, at which it is determined whether the decision rendered at the step S4 in the last loop was YES, namely whether the engine rotational speed has decreased and has just crossed the predetermined rotational speed Nsa. If the answer here is YES, namely that the rotational speed of the engine has just crossed Nsa, the program proceeds to a step S7; if NO is the answer, then the next step executed is a step S11.

At the step S7, the CPU 50 goes to an Ne-DNEon table, which has been stored in the memory 51, to read out a value of DNEon on the basis of the present engine rotational speed sensed at the step S1. As will become clear from the following description of steps S8 through S10, DNEon is a first threshold value of the engine speed differential and decides whether the control variable Isa should be produced as an output or not. Table 1 given below as an example of the Ne-DNEon table shows the relationship between the engine rotational speed Ne and the first threshold value DNEon.

TABLE 1

| Ne (rpm) | 1350~1101 | 1100~951 | 950~0 |
|---|---|---|---|
| DNEon (rpm/1 TDC) | 15 | 8 | 0 |

The step S7 is followed by a step S8, at which it is determined whether the speed differential ΔNe calculated at the step S5 is greater than the value of the first threshold value DNEon looked up in the Ne-DNEon table at the step S7. If the answer to the step S8 is NO, the next step executed is the step S14; if YES, the program proceeds to a step S9.

The step S9 calls for the CPU 50 to look up a value for the control variable Isa in an Ne-ΔNe-Isa table, which has been stored in the memory 51, based on the present engine rotational speed Ne(n) read in at the step S1 and the speed differential ΔNe calculated at the step S5. Table 2 given below illustrates this table, which shows the relationship among the engine rotational speed Ne, the speed differential ΔNe and control variable Isa.

TABLE 2

| | Ne (rpm) | | |
|---|---|---|---|
| ΔNe (rpm/1 TDC) | 1350~1101 | 1100~951 | 950~0 |
| 20 OR MORE | Isa (C) | Isa (B) | Isa (A) |
| 15~19 | Isa (D) | Isa (C) | Isa (B) |
| 8~14 | 0 | Isa (D) | Isa (C) |
| 7 OR LESS | 0 | 0 | Isa (D) |

It should be noted that the subscripts (A) through (D) following Isa indicate the magnitude (value) of Isa, where Isa(A)>Isa(B)>Isa(C)>Isa(D). Also, Isa is set at zero if the engine rotational speed is between 1350 and 1101 rpm and the speed differential is less than 14 rpm, or if the engine rotational speed is between 1100 and 951 rpm and the speed differential is 7 rpm or less.

Thus, in the present embodiment, the arrangement is such that the higher the rotational speed Ne of the engine, the larger the value of the speed differential ΔNe needed to generate a control variable Isa of the same value, and such that the magnitude of the control variable Isa has a tendency to increase with an increase in the speed differential ΔNe for the same value of Ne. This is clearly shown by Table 2.

The step S9 is followed by a step S10, at which the control variable Isa decided at the step S9 is delivered as the solenoid current command Icmd to the control valve driving circuit 54. Processing in accordance with the main program is executed following the step S10.

As the result of the step S10, the degree to which the control valve 30 is opened is regulated by the control valve driving circuit 54 and solenoid 16 in dependence upon the value Icmd. Note that when Isa is set at zero (step S14), the solenoid current command value Icmd is not issued.

The step S11, which is reached when a NO decision is rendered at the step S6, calls for a determination as to whether the control variable Isa was issued as the solenoid current command value Icmd at step S10 in the last loop. If the answer to the step S11 is NO, then the program proceeds to the step S7; if YES, the next step executed is a step S12. This step calls for the CPU 50 to read out DNEoff from an Ne-DNEoff table, which has been stored in the memory 51, based on the present engine rotational speed sensed at the step S1.

As will become apparent from the following explanation of steps S13 and S14, DNEoff is a second threshold value of the engine speed differential and decides whether the generation of the control variable Isa is to be terminated or not. The following Table 3 is a table showing the relationship between the engine rotational speed Ne and the second threshold value DNEoff.

TABLE 3

| Ne (rpm) | 1200 OR MORE | 1199~1100 | 1099~1000 | 999~900 | 899~800 | 799~700 | 699 OR LESS |
|---|---|---|---|---|---|---|---|
| DNEoff (rpm) | 6 | 5 | 4 | 3 | 2 | 1 | 0 |

It will be learned from a comparison of Tables 1 and 3 that the first threshold value DNEon is set to be larger than the second threshold value DNEoff for the same value of engine rotational speed Ne.

The step S13 calls for the CPU 50 to determine whether the speed differential ΔNe calculated at the step S5 is greater than the value of the second threshold value DNEoff looked up in the Ne–DNEoff table at the step S12. If the answer to the step S13 is YES, the program proceeds to the step S9; if NO, the next step executed is the step S14 in order to end the generation of the control variable Isa. The control variable Isa is set to zero at the step S14, after which the program proceeds to the step S10. Now the value of Icmd will be zero.

Though the value of the control variable Isa is applied directly to the control valve driving circuit 54 as the solenoid current command value Icmd in the case described above, the invention is not limited to such an arrangement. As an alternative, the control variable Isa can be added to the aforementioned learned value Ixref, which is calculated at a step S27 of a flowchart shown in FIG. 4, described below, and stored in the memory 51, and the sum of these two values can then be delivered to the control valve driving circuit 54 as the solenoid current command value Icmd.

As shown in Table 3, when the rotational speed of the engine declines smoothly and approaches the upper limit value (e.g. 790 rpm) of the idling speed region, the second threshold value DNEoff decided at the step S12 is 1 rpm in accordance with the present embodiment of the invention. Accordingly, if the actual speed differential ΔNe of the engine rotational speed at this time is determined to be less than 1 at the step S13, generation of the control variable Isa ceases. Consequently, when delivery of Isa is ended in this manner, a smooth transition can be made to the feedback mode since a YES decision (a decision to the effect that the feedback mode is in effect) will be rendered the next time step S2 is executed.

Figure 4:
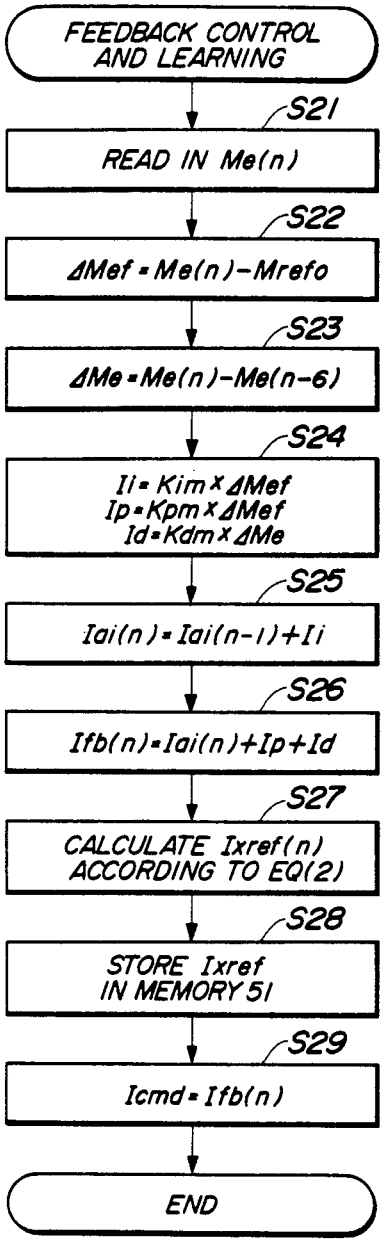
FIG. 4 is a flowchart illustrating in detail the processing involved in step S3 contained in the flowchart of FIG. 3.

FIG. 4 is a flowchart illustrating in detail the processing involved in the step S3 of the flowchart shown in FIG. 3.

The first step, shown at S21, calls for the CPU 50 to read in the reciprocal of the engine rotational speed (namely the period of the TDC pulse signal) sensed by the counter 2, or a variable Me(n) corresponding to the value of the reciprocal. This is followed by a step S22, at which the CPU 50 calculates an error ΔMef between Me(n) read at the step S21 and either the reciprocal of a predetermined target idling rotational speed Nrefo or a variable Mrefo corresponding thereto. Next, at a step S23, the CPU 50 calculates the difference between Me(n) and the immediately preceding measured value of Me for the same cylinder [for an engine having six cylinders, this immediately preceding measured value is Me(n-6)]. The calculated difference is equivalent to the rate of change, denoted ΔMe, of the period.

Next, at a step S24, the CPU 50 uses ΔMef, ΔMe, an integral term control gain Kim, a proportional term control gain Kpm and a differential term control gain Kdm to calculate the integral term Ii, proportional term Ip and differential term Id in accordance with the calculation formulae illustrated. It should be noted that each of these control gains is obtained by reading out a value stored previously in the memory 51.

The program then proceeds to a step S25, at which the integral term Ii obtained at the step S24 is added to Iai(n-1) to obtain Iai(n). Since Iai(n) obtained here will become Iai(n-1) in the next cycle of processing, Iai(n) is stored temporarily in the memory 51. If Iai(n) has not as yet been stored in the memory 51, however, all that need be done is to store a numerical value analagous to Iai in memory 51 beforehand and read out this numerical value as Iai(n-1).

The foregoing is followed by a step S26, where Ip and Id calculated at the step S24 are added to Iai(n) calculated at the step S25. The sum is defined as Ifb(n). Next, the learned value Ixref(n) defined by the following Equation (2) is calculated at a step S27:

$$Ixref(n) = Iai(n) \times Ccrr/m + Ixref(n-1) \times (m - Ccrr)/m \quad (2)$$

where m and Ccrr are positive numbers set at will and are related by the inequality $m > Ccrr$.

The program proceeds to a step S28, at which the learned value Ixref calculated as set forth above is stored in the memory 51, and then to a step S29, at which Ifb(n) calculated at the step S26 is applied to the control valve driving circuit 54 as the solenoid current command value Icmd. This is followed by returning to the main program.

Thus, according to the present invention as described above, the period of time during which the control variable Isa is delivered as an output is not predetermined as in the prior art. Rather, according to the invention, the generation of the control variable Isa is ended only when the speed differential ΔNe of engine rotational speed falls below a second threshold value, which is preset for each of several regions of engine rotational speed.

By virtue of the feature of the invention that the period of time during which the control variable Isa is outputted can be suitably controlled in accordance with engine rotational speed and the speed differential thereof even if internal combustion engines differ slightly from one another, it is possible to avoid situations in which engine rotational speed does not stabilize smoothly at a target idling speed due to a rise in the engine rotational speed caused by the control variable Isa or due to the fact that a sharp decline in the rotational speed cannot be prevented because the control variable Isa is outputted for too short a period of time. In other words, the invention makes it possible for engine rotational speed to smoothly attain an idling rotational speed in a feedback control mode transition from open-loop control mode to feedback control mode.

As many apparently widely different upon embodiments of the present invention can be made without departing from the spirit and scope thereof, it is to be understood that the invention is not limited to the specific embodiments thereof except as defined in the appended claims.

What is claimed is:

1. A method of controlling idling rotational speed of an internal combustion engine having a throttle valve and a control valve arranged in a bypass passage bypassing the throttle valve, wherein the degree to which the control valve is opened is controlled in proportion to a control valve command signal to regulate an amount of air taken into the engine, thereby controlling the idling rotational speed of the engine, the method comprising the steps of: (1) sensing the rotational speed of the engine, as well as a rate of decrease in engine rotational speed when the engine rotational speed is decreasing; (2) determining whether the sensed rotational speed falls below a predetermined value; (3) generating the control valve command signal having a command value dependent upon both the sensed engine rotational speed and the sensed rate of decrease in engine rotational speed when the sensed engine rotational speed falls below the predetermined value; (4) determining whether the sensed rate of decrease in engine rotational speed falls below a predetermined threshold value preset in dependence upon the engine rotational speed; and (5) terminating generation of the control valve command signal when the sensed rate of decrease in engine rotational speed falls below the predetermined threshold value.

2. A method as claimed in claim 1 wherein generation of the control valve command signal takes place only if the sensed rate of decrease in engine rotational speed is not less than predetermined value preset in dependence upon the engine rotational speed.

3. A method as claimed in claim 1 or 2, wherein the engine rotational speed is sensed whenever each pulse of a control timing signal is generated, and the rate of decrease in engine rotational speed is decided based on a difference between a value of engine rotational speed sensed at generation of a present pulse of the control timing signal and a value of engine rotational speed sensed at a preceding pulse of the control timing signal.

4. A method as claimed in claim 1 or 2, wherein said command value of the control valve command signal dependent upon both the sensed rotational speed and the sensed rate of decrease in engine rotational speed is applied to control the degree to which the control valve is opened.

5. A method as claimed in claim 1 or 2, wherein a sum of said command value of the control valve command signal dependent upon both the sensed rotational speed and the sensed rate of decrease in engine rotational speed and a value learned from command values applied during feedback control of idling rotational speed is applied to control the degree to which the control valve is opened.

6. A method as claimed in claim 1 or 2, wherein said predetermined value of the engine rotational speed is higher than a desired idling speed of the engine.

7. A method as claimed in claim 1, wherein the engine rotational speed is sensed whenever each pulse of a control timing signal is generated, the rate of decrease in engine rotational speed is decided based on a difference between a value of engine rotational speed sensed at generation of a present pulse of the control timing signal and a value of engine rotational speed sensed at a preceding pulse of the control timing signal, and said command value of the control valve command signal dependent upon both the sensed rotational speed and the sensed rate of decrease in engine rotational speed is applied to control the degree to which the control valve is opened.

8. A method as claimed in claim 7, wherein said predetermined value of the engine rotational speed is higher than a desired idling speed of the engine.

9. A method of controlling idling rotational speed of an internal combustion engine having a throttle valve and a control valve arranged in a bypass passage bypassing the throttle valve, wherein the degree to which the control valve is opened is controlled in proportion to a control valve command signal to regulate an amount of air taken into the engine, thereby controlling the idling rotational speed of the engine, the method comprising the steps of: (1) sensing the rotational speed of the engine, as well as a rate of decrease in engine rotational speed when the engine rotational speed is decreasing; (2) determining whether the sensed rotational speed falls below a predetermined value; (3) generating the control valve command signal having a command value dependent upon both the sensed engine rotational speed and the sensed rate of decrease in engine rotational speed when the sensed engine rotational speed falls below the predetermined value; (4) determining whether the sensed rate of decrease in engine rotational speed falls below a predetermined threshold value; (5) applying a sum of said command value of the control valve command signal dependent upon both the sensed rotational speed and the sened rate of decrease in engine rotational speed and a value learned from command values applied during feedback control of idling rotational speed to control the degree to which the control valve is opened; and (6) terminating generation of the control valve command signal when the sensed rate of decrease in engine rotational speed falls below the predetermined threshold value.

10. A method as claimed in claim 9, wherein said predetermined value of the engine rotational speed is higher than a desired idling speed of the engine.

11. A method as claimed in claim 3, wherein said predetermined value of the engine rotational speed is higher than a desired idling speed of the engine.

12. A method as claimed in claim 4, wherein said predetermined value of the engine rotational speed is higher than a desired idling speed of the engine.

* * * * *